US009896951B2

(12) United States Patent
Facchinetti et al.

(10) Patent No.: US 9,896,951 B2
(45) Date of Patent: Feb. 20, 2018

(54) TURBINE VANE WITH COOLED FILLET

(71) Applicant: ANSALDO ENERGIA SWITZERLAND AG, Baden (CH)

(72) Inventors: Emanuele Facchinetti, Zurich (CH); Guillaume Wagner, Lausanne (CH); Marc Henze, Wettingen (CH); Joerg Krueckels, Birmenstorf (CH); Marc Widmer, Winterhur (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 259 days.

(21) Appl. No.: 14/662,319

(22) Filed: Mar. 19, 2015

(65) Prior Publication Data

US 2015/0267549 A1 Sep. 24, 2015

(30) Foreign Application Priority Data

Mar. 20, 2014 (EP) ..... 14160874

(51) Int. Cl.
*F01D 5/18* (2006.01)
*F01D 9/06* (2006.01)
(Continued)

(52) U.S. Cl.
CPC ..... *F01D 9/065* (2013.01); *F01D 5/188* (2013.01); *F01D 5/189* (2013.01); *F01D 9/041* (2013.01);
(Continued)

(58) Field of Classification Search
CPC ..... F01D 5/188; F01D 5/189; F01D 9/065; F05D 2240/81; F05D 2260/201
See application file for complete search history.

(56) References Cited

U.S. PATENT DOCUMENTS 3,628,880 A 12/1971 Smuland et al.
6,062,817 A * 5/2000 Danowski ..... B22C 9/103 416/229 A
(Continued)

FOREIGN PATENT DOCUMENTS

CN 1793616 A 6/2006
EP 1 160 418 A2 12/2001
EP 2418355 A1 * 2/2012 ..... F01D 5/189

OTHER PUBLICATIONS

Office Action (First Office Action) dated Jul. 3, 2017, by the State Intellectual Property Office (SIPO) of the People's Republic of China in corresponding Chinese Patent Application No. 201510118365.9, and an English Translation of the Office Action. (11 pages).

*Primary Examiner* — Ninh H Nguyen
(74) *Attorney, Agent, or Firm* — Buchanan Ingersoll & Rooney PC

(57) ABSTRACT

The disclosure pertains to a vane comprising a platform and airfoil extending form said platform and connected to the platform by a fillet. An impingement tube is inserted into said airfoil delimiting a cooling channel between the impingement tube and the side walls. The vane further comprises a baffle structure positioned adjacent the fillet and which follows the inside contour of the fillet; delimiting a first cooling passage between the fillet and the baffle structure. A first obstruction is arranged on the inside of the airfoil at the connection of the fillet to the side walls for separating the first cooling passage from the cooling channel in the airfoil and to guide the cooling gas from the first cooling passage into the impingement tube. The disclosure further refers to a method for cooling such a vane.

14 Claims, 4 Drawing Sheets

(51) Int. Cl.
*F01D 9/04* (2006.01)
*F01D 9/02* (2006.01)

(52) U.S. Cl.
CPC ..... *F01D 9/02* (2013.01); *F05D 2220/32* (2013.01); *F05D 2240/81* (2013.01); *F05D 2260/201* (2013.01); *F05D 2260/205* (2013.01)

(56) References Cited

U.S. PATENT DOCUMENTS

| | | | | |
|---|---|---|---|---|
| 6,561,757 | B2 * | 5/2003 | Burdgick | F01D 5/186 415/114 |
| 7,172,329 | B2 * | 2/2007 | Kao | G02B 6/0086 362/633 |
| 7,431,559 | B2 | 10/2008 | Paauwe et al. | |
| 8,142,874 | B1 * | 3/2012 | Jefferson | B64G 1/22 428/116 |
| 2003/0026689 | A1 | 2/2003 | Burdgick et al. | |
| 2003/0035726 | A1 * | 2/2003 | Tiemann | F01D 5/189 416/97 R |
| 2004/0258523 | A1 | 12/2004 | Naik et al. | |
| 2006/0133923 | A1 | 6/2006 | Paauwe et al. | |
| 2008/0166240 | A1 * | 7/2008 | Scott | F01D 5/187 416/232 |
| 2010/0310367 | A1 * | 12/2010 | Devore | F01D 5/189 416/1 |
| 2011/0123351 | A1 * | 5/2011 | Hada | F01D 5/189 416/97 R |
| 2011/0259110 | A1 * | 10/2011 | Smith | G01B 3/18 73/760 |
| 2013/0315725 | A1 | 11/2013 | Uechi et al. | |

* cited by examiner

TURBINE VANE WITH COOLED FILLET

CROSS-REFERENCE TO RELATED APPLICATIONS

This application claims priority to European application 14160874.5 filed Mar. 20, 2014, the contents of which are hereby incorporated in its entirety.

TECHNICAL FIELD

The present invention relates to a turbine vane, and more particularly to a cooled vane with a fillet interposed between a platform and an airfoil of the vane. Further, it relates to a method for cooling such a vane.

BACKGROUND

The thermodynamic efficiency of power generating cycles depends on the maximum temperature of its working fluid which, in the case for example of a gas turbine, is the temperature of the hot gas exiting the combustor. The maximum feasible temperature of the hot gas is limited by combustion emissions as well as by the operating temperature limit of the parts in contact with this hot gas, and on the ability to cool these parts below the hot gas temperature. In particular blades, i.e. rotating blades and vanes (stationary blades), are exposed to high temperature combustion gases, and consequently are subject to high thermal stresses. Methods are known in the art for cooling the vanes and reducing the thermal stresses. Typically high pressure air, discharged from a compressor, is introduced into an interior of an air-cooled vane from a vane root portion. After cooling the vane the cooling gas is discharged from the vane into a hot gas flow path of the gas turbine.

The region of a vane where the airfoil is connected to the platform is highly loaded and often subject to additional stresses due to thermal mismatches and different thermal expansions of the airfoil and the platform. For a smooth transition and to reduce peaks in the stress distribution a rounded transition from platform to airfoil has been suggested. Such rounded transitions or connections are typically called fillet.

However cooling of fillets is difficult and requires additional cooling gas flow, which can lead to a reduction in power and efficiency.

SUMMARY

The object of the present disclosure is to propose a vane, which avoids high stresses in the fillet region and assures safe efficient cooling of the fillet as well as efficient use of the cooling gas, i.e. the disclosed vane provides adequate cooling for the platform-to-airfoil transition region in a vane.

According to a first embodiment the vane comprises a platform, and airfoil extending in longitudinal direction away from the platform. A fillet is connecting the platform to the airfoil. The airfoil can extend from the platform to an airfoil tip or to an opposite platform. The airfoil has a pressure side delimited by a pressure side wall, and a suction side delimited by a suction side wall. Pressure side wall and suction side wall join at a leading edge and at a trailing edge. An impingement tube can be inserted into the airfoil delimiting a cooling channel between the impingement tube and the side walls. The vane further comprises a baffle structure positioned adjacent the fillet which follows the inside contour of the fillet and is delimiting a first cooling passage between the fillet and the baffle structure. The inside of the vane, e.g. of the fillet, is the side facing away from the hot gas side during operation of a turbine with such a vane. A first obstruction is arranged on the inside of the airfoil at the connection of the fillet to the side walls for separating the first cooling passage from the cooling channel. This obstruction can further guide the cooling gas away from the airfoil side walls.

Due to this separation cooling gas which has been used in the cooling channel can be reused for further cooling purposes. To reduce stresses the fillet can have a large curvature in the order of up to the thickness of the airfoil at the root (i.e. connection region to the platform). To minimize stresses due to different thermal expansions during transients in the gas turbine operation the fillet ideally has a constant wall thickness. In case the wall thickness of the airfoil side walls is different from the wall thickness of the platform a continuous change of fillet wall thickness can be advantageous. As a result the inner contour of the fillet can have a bell mouth like shape. Due to the curvature and resulting large surface area of this bellmouth shaped fillet a large amount of cooling gas might be needed for cooling of the fillet. The reuse of the fillet cooling for further cooling of the vane can therefore significantly contribute to a good overall efficiency of the turbine.

It can be advantageous if the fillet cooling is supplied independently from the airfoil cooling. Preferably the fillet cooling gas is reused for cooling the airfoil. With an independent cooling scheme and reuse of the cooing air it is possible to increase the coolant consumption in this region without affecting the airfoil cooling design and without increasing the overall cooling consumption of the vane. In this way the airfoil cooling performance can be independently optimized.

The cooling gas can be air which has been compressed by a compressor of a gas turbine if the vane is installed in an air breathing gas turbine. It can be any other gas or mixture of gases. For example it can be a mixture of air and flue gases for a gas turbine with flue gas recirculation into the compressor inlet. The vane can have a platform at one end of the airfoil and ending with a tip at the other end of the airfoil. In this case the cooling gas is supplied from the side of the platform. The vane can also have a platform on both sides of the platform. In a vane with platforms on both sides the cooling gas can be supplied from both sides or from either side. If the cooling gas is supplied only to one side of a vane with two platforms the vane typically includes a channel or duct in the hollow airfoil for feeding cooling gas from the side with cooling gas supply to the opposite side.

According to another embodiment the vane comprises a second impingement structure adjacent the platform which follows the contour the platform. This second impingement structure delimits a second cooling passage between the platform and the second impingement structure. The impingement structure can partly or completely cover the platform, i.e. the platform is partly completely impingement cooled through the impingement structure.

In one embodiment of the vane cooling gas used to impingement cool the platform in the region of the second cooling passage can flow to the first cooling passage to convectively cool the fillet while passing through the first cooling passage.

In one embodiment of the vane the baffle structure comprises impingement holes for impingement cooling of the fillet.

In a further embodiment of the vane a second obstruction is arranged on the inside of the platform at the connection between the second cooling passage and the first cooling passage for separating the first cooling passage from the second cooling passage. The obstruction avoids a cross flow of cooling gas from the second cooling passage through the first cooling passage which could have a detrimental effect on the impingement cooling in the first passage. The second obstruction can partly or completely separate the first cooling passage from the second cooling passage.

The cooling gas used for impingement cooling the platform can for example be fed from the second cooling passage to impingement tube of the airfoil for further use.

In one embodiment of the vane the second obstruction spans around the circumference of the fillet. In an alternative embodiment the second obstruction extends around the leading edge and or the trailing edge for shielding the impingement cooling of the filet from a cross flow of cooling gas coming from second cooling passage towards the first cooling passage in the leading edge region and/or trailing edge region of the fillet.

In another embodiment of the vane the second cooling passage has an opening to the first cooling passage such that cooling gas flows from the second cooling passage to first cooling passage. The opening can be a seamless connection of the baffle structure with the second impingement structure. These can even be combined into one structure or in one piece or one plate. The cooling gas leaving the second cooling passage can thus be reused for subsequent convective cooling of the fillet during operation.

In another embodiment of the vane the second cooling passage has an opening and connection such as a flow channel or connecting plenum to the impingement tube such that cooling gas flows from second cooling passage to the impingement tube for subsequent impingement cooling of the airfoil during operation.

In yet another embodiment of the vane the first cooling passage has an opening or flow channel to the impingement tube such that cooling gas flows from first cooling passage into impingement tube for subsequent impingement cooling of the airfoil during operation.

It can further be advantageous if the fillet or fillet region comprises a row of film cooling holes arranged in the fillet wall such that during operation cooling gas from the first cooling passage is used for film cooling of the fillet after impingement cooling. Further or alternatively, the platform can comprise at least one convective cooling hole arranged in the platform such that during operation cooling gas from the second cooling passage is used for convective cooling of the platform after impingement cooling. This convective cooling hole can discharge the cooling gas into the hot gas flow path.

Film cooling of the fillet and convective cooling of the platform can be used to discharge all of the cooling gas flowing into the first cooling passage and into the second cooling passage thereby completely decoupling the airfoil cooling from the platform and fillet cooling. The film cooling holes in the fillet and convective cooling holes in the platform can also be arranged in combination with an opening or flow channel connecting the first cooling passage to the impingement tube of the airfoil such than part of the cooling gas is reused for impingement cooling of the airfoil and part of the cooling gas is used for film cooling and/or convective cooling.

In a further embodiment of the vane the fillet has a curved shape with an outer surface facing the hot gases during operation wherein the curvature is tangentially to the outer surface of the platform at the connection of the filet to the platform and tangentially to the outer surface of the airfoil at the connection the filet to the airfoil.

In yet another embodiment the fillet has wall thickness which is equal to wall thickness of the platform at the connection to platform and which is equal to the wall thickness of the airfoil side walls at the connection to the airfoil side walls to minimize stresses. The wall thickness of the fillet can for example continuously decreases or continuously increases along the extension of the fillet from the platform to the side walls. The wall thickness can for example also change with continuous first order derivative, i.e. the thickness changes continuously without any steps along the extension of the fillet from a connection to the platform to the connection to the side walls.

In another embodiment of the vane the impingement tube is arranged inside a leading edge section of the airfoil, and a convective cooling section is arranged inside a trailing edge section of the airfoil. A wall is dividing the convective cooling section into a first convective cooling section adjacent to the platform and into a second convective cooling section extending towards the vane tip, respectively extending towards a platform at the opposite end of the airfoil.

The rib can further serve to guide the cooling gas in the first passage along the root of the airfoil.

Convective cooling in the first and/or second convective cooling section can be enhanced by turbulator such as for example a pin field and/or cooling ribs.

In a further embodiment a cooling gas feed is connecting the first cooling passage to the first convective cooling section for directly feeding cooling gas from the first cooling passage to first convective cooling section. Thus the cooling gas leaving the first passage is not flowing via the impingement tube into the convective cooling section but directly from the first cooling passage. The pressure of the cooling gas therefore remains higher in the first cooling passage to effectively cool the root section of the airfoil.

Besides the vane a method for cooling a vane is an object of the disclosure.

The disclosed vane allows good cooling of a fillet and reduces stresses in the fillet. Further, it allows the reuse of the cooling gas spent for cooling the fillet.

The vane which is to be cooled by that method has a platform, an airfoil extending in longitudinal direction away from the platform extending form the platform and connected to the platform by a fillet. The airfoil has a pressure side and a suction side with a pressure side wall and a suction side wall, which join at a leading edge and at a trailing edge. An impingement tube is inserted into said airfoil delimiting a cooling channel between the impingement tube and the side walls. The method for cooling such a vane comprises the following steps:

- supplying cooling gas to a baffle structure positioned adjacent the fillet which follows the inside contour of the fillet and delimits a first cooling passage between the fillet and the baffle structure,
- impinging the cooling gas onto the fillet for impingement cooling,
- after impingement guiding the cooling gas leaving the first cooling passage with the help of an obstruction arranged on the inside of the airfoil at the connection of the fillet to the side walls into the impingement tube, and
- impinging the cooling gas on the side walls of the airfoil.

BRIEF DESCRIPTION OF THE DRAWINGS

The disclosure, its nature as well as its advantages, shall be described in more detail below with the aid of the accompanying schematic drawings. Referring to the drawings.

DETAILED DESCRIPTION

Figure 1:
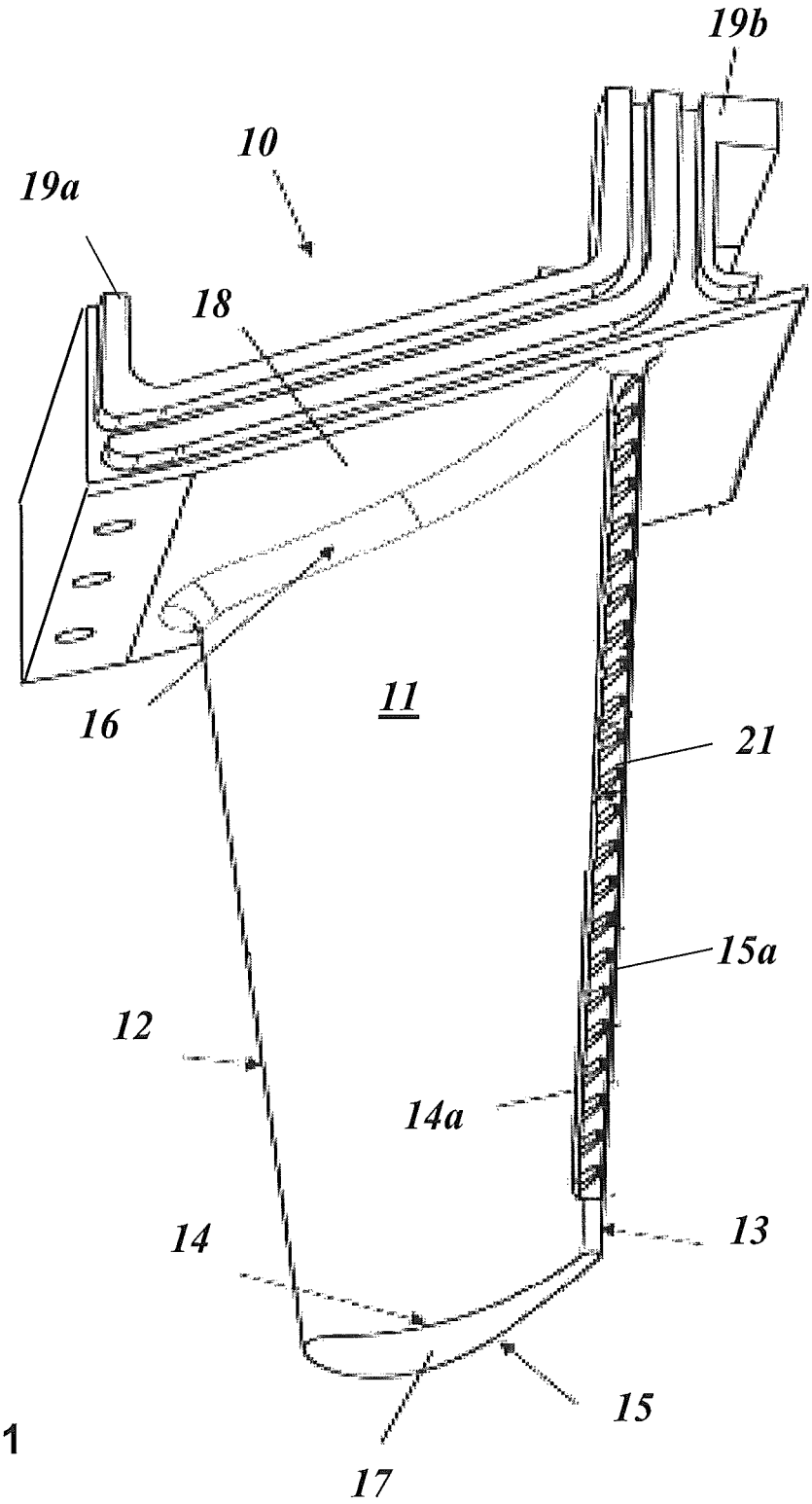
FIG. 1 shows a perspective view of an exemplary turbine vane.

A vane 10 of a turbine according to an exemplary embodiment of the disclosure is shown in FIG. 1. The vane 10 has an airfoil 11 which extends in the longitudinal direction from a platform 18 to a vane tip 17. The longitudinal direction of the airfoil 11 in this context is the direction from platform to tip, respectively from platform to opposite platform of the vane. This direction is typically practically perpendicular to the flow direction of hot gases in the flow path of a turbine. The airfoil 11 has a pressure side 14 and a suction side 15 and also a leading edge 12 and a trailing edge 13. The platform 18 is provided with hook-like fastening elements 19*a* and 19*b* on the top. The airfoil 11 merges into the platform 18 with a fillet 16 at a root. At the trailing edge 13, discharge openings 21 for cooling gas are arranged in a distributed manner along said trailing edge 13 and are separated from each other by means of ribs 32 disposed in between. The airfoil 11 is outwardly delimited by a pressure-side wall 14*a* and a suction-side wall 15*a*. Film cooling gas holes can be arranged on the surface of the suction-side wall 15*a* and pressure-side wall 16*a* (not shown). These can be advantageous in leading edge region of the side walls 14*a*, 15*a*

The vane shown in FIG. 1 has an airfoil 11 extending from one platform 18 and ending at a tip 17. Depending on the design and application a vane can comprise two platforms 18 with an airfoil 11 extending from one platform to another platform.

Figure 2A:
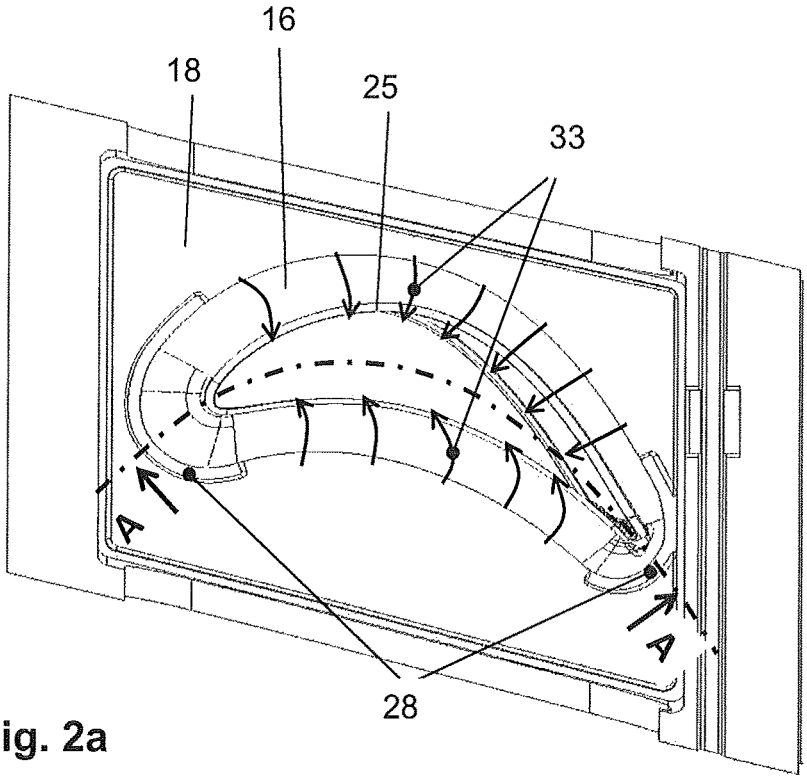
FIG. 2*a*, 2*b* shows bottom view of the foot of the vane from FIG. 1.

FIG. 2*a* shows the platform 18 in a top view of the vane in FIG. 1 In the top view of FIG. 2*a* impingement plates, and baffles for guides the cooling gas are omitted to allow a view into the vane. The FIG. 2*a* shows platform 18. The airfoil itself is not visible as it is pointing away from the platform 18 but an opening with the aerodynamic profile of the platform is visible. A curved fillet 16 connecting the platform 18 to the airfoil encircles the profiled vane opening. During operation cooling gas 33 flows from the platform 18 across the fillet following the curvature of the fillet 16. To further guide the cooling gas flow 33 a first obstruction 25 is arranged on the inside of the vane at the connection of the fillet 16 to the airfoil. Second obstructions 28 are arranged on the platform 18 at the connection of the fillet 16 to the platform 18 in the leading edge as well as in a trailing edge region. The second obstructions 28 shield the leading edge and the trailing edge regions of the fillet 16 from a cross flow of cooling gas from the platform 18 during operation.

Figure 2B:
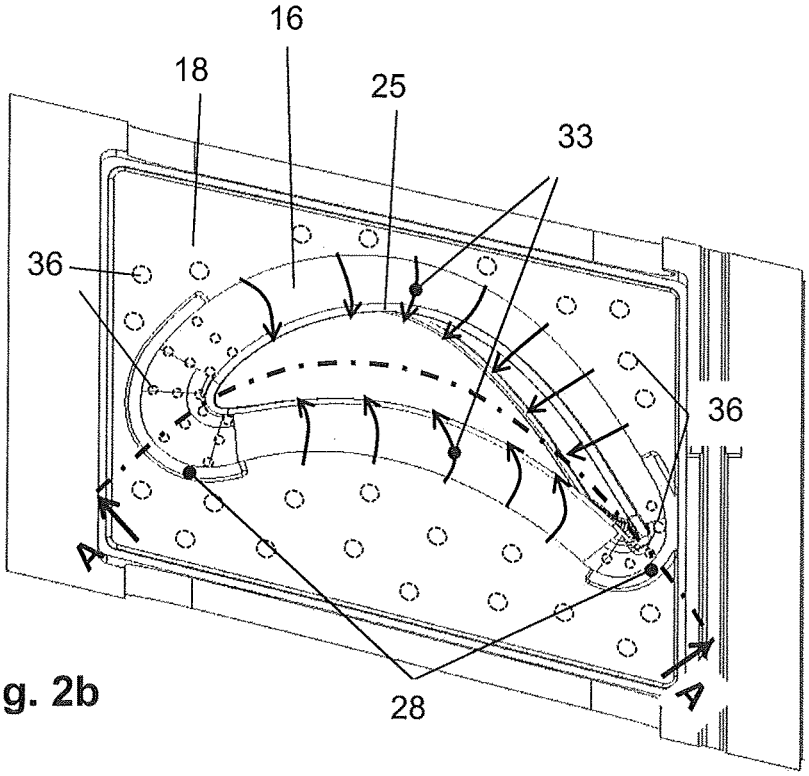

FIG. 2*b* is based on FIG. 2*a*. Here examples for the location of impingement cooling holes 36 are indicated. In this example cooling holes 36 are distributed above the platform and in a leading edge as well as in a trailing edge region of the fillet 16. An effective impingement cooling of the leading edge and trailing edge region of the fillet 16 is enhanced by the second obstructions 28 which shield it from cooling gas 33 flowing from the platform 18 towards the airfoil.

FIGS. 3, 5, 6, and 7 show the cut A-A of the vane 10 indicated in FIG. 2*a*, 2*b*. They show different examples of the platform, fillet-airfoil connection with corresponding cooling schemes. Only a cut-out of the airfoil 11 region close to the platform is shown since a tip region is not subject of the invention. If the vane 10 comprises platforms on both ends of the airfoil 11 these can be designed in according to the same principles shown.

Figure 3:
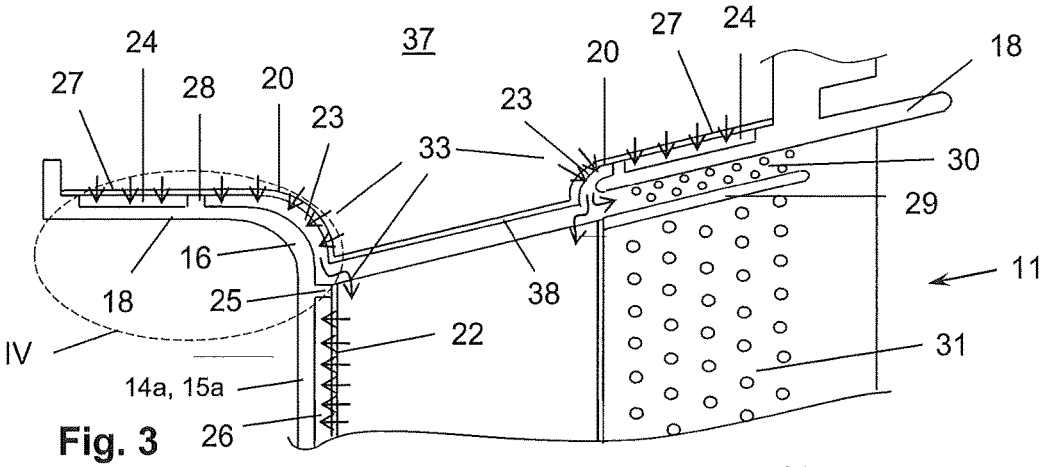
FIG. 3 shows an example the cross-section the platform and a cut out of the airfoil at the connection to the platform.

The vane of FIG. 3 comprises a platform 18, an airfoil 11 extending away from the platform 18 into a hot gas flow (during operation). The airfoil 11 is connected to the platform 18 by a fillet 16. The fillet 16 is curved and asymptotic to the platform 18, respectively to the airfoil 11 at the respective connection as can be seen here for the leading edge region.

A baffle structure 20 is positioned adjacent to the fillet 16 and follows the inside contour of the fillet 16. A first cooling passage 23 is arranged between the fillet and the baffle structure 20. In this example the baffle structure 20 is configured as an impingement plate for impingement cooling of the fillet 16 with pressurized cooling gas 33 supplied from a plenum 37 above the baffle structure 20.

An impingement tube 22 is inserted into the airfoil 11 delimiting a cooling channel 26 between the impingement tube 22 and the side walls 14*a*, 15*a*. The impingement tube 22 is arranged next to the leading edge of the airfoil 11 allowing an impingement cooling of the side walls 14*a*, 15*a* in the leading edge region. After impinging on the side walls 14*a*, 15*a* the cooling gas 33 can be used to further cool the airfoil by discharging it to the outer surface of the airfoil through film cooling holes (not shown) or by guiding it through a cooling channel 26 formed by the side walls 14*a*, 15*a* and the impingement tube 22 along the side walls 14*a*, 15*a* towards the trailing edge of the vane, and thereby convectively cooling the airfoil 11.

Between the first cooling passage 23 and the cooling channel 26 a first obstruction 25 is arranged on the inside of the airfoil 11 at the connection of the fillet 16 to the side walls 14*a*, 15*a*. The first obstruction 25 prevents cooling gas 33 from flowing out of the first cooling passage 23 directly into the cooling channel 26 and forces the cooling gas 33 to flow out of an opening of the first cooling passage 23 into the impingement tube 22. Thus the cooling gas 33 can be used twice. A closing plate 38 above the upper end of the impingement tube prevents a direct flow of the cooling gas 33 from plenum 37 into the impingement tube 22.

In this example the vane further comprises a second impingement structure 27 adjacent the platform 18. This second impingement structure 27 is configured as an impingement plate arranged offset and parallel to the platform. A second cooling passage 24 is formed between the platform 18 and the second impingement structure 27.

Cooling gas 33 impinges on the platform 18 and then flows along the platform's 18 inner surface in the second cooling passage.

In this example the vane has a second obstruction 28 which is arranged on the inside of the platform 18 at the connection between the second cooling passage 24 and the first cooling passage 23. The second obstruction at least partly separates first cooling passage 23 from the second cooling passage 24 and thereby prevents a cross flow of cooling gas 33 from the second cooling passage 24 in the impingement cooled first cooling passage 23.

The cooling gas 33 leaves the second cooling passage 24 via an opening and can be guided directly to the impingement tube 22 (not shown) or can flow through the sections of the first cooling passage 23 which are not blocked by the second obstruction (not shown here but indicated in FIG. 2*a*, 2*b*).

The airfoil region downstream of the impingement tube 22, i.e. in flow direction of hot gases flowing around the vane during operation, can be convectively cooled with the cooling gas 33 leaving the impingement tube 22 or cooling gas directly fed into the space between the side walls 14*a*, 15*a* downstream of the impingement tube 22. In this example a first and a second convective cooling section 30, 31 are arranged downstream of the impingement tube 22 in the airfoil 11 for convectively cooling the side walls 14*a*, 15*a*. The first convective cooling section 30 is fed with cooling gas coming from the first cooling passage 23 after the cooling gas 33 has cooled the fillet 16. The first convective cooling section 30 is separated from the second convective cooling section 31 by a wall 29 which extends basically parallel to the platform 18 and spans between the pressure side wall 14*a* and the suction side wall 15*a*. The second convective cooling section 1 is feed from cooling gas 33 leaving the cooling channel 26 after impingement cooling. In this arrangement cooling gas 33 with a higher pressure level is feed to the first convective cooling section 30 near the platform to better cool this highly loaded region. In the examples shown here the first and second convective cooling sections 30, 31 are configured as pin fields. Instead of pin fields other heat transfer enhancements can be used or depending on the cooling requirements at least part of the side walls can have a smooth inner surface.

Figure 4:
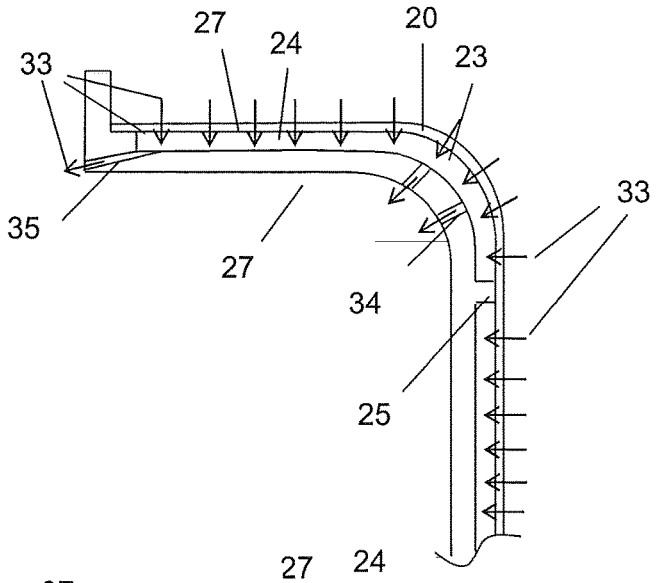
FIG. 4 shows a modified detailed of the platform of FIG. 3.

FIG. 4 shows a variation of the platform 18 cooling design of the detail IV indicated in FIG. 3. In this example the first cooling passage 23 and second cooling passage 24 are connected and no obstruction is interposed between them. Further, the baffle structure 20 and the second impingement structure 27 are incooperated into one impingement plate following the contour of the platform 18 and around the curvature of the fillet 16.

In this example the cooling gas 33 feed to the first and second cooling passage is further used for film cooling the fillet 16 through film cooling holes 34 and for convectively cooling the upstream end of the platform 18 through convective cooling holes 35.

Figure 5:
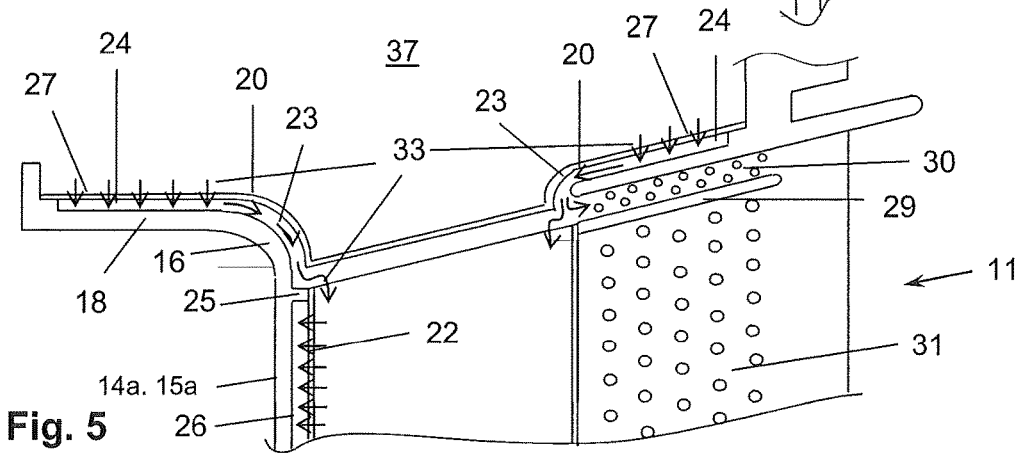
FIG. 5 shows another example the cross-section the platform and a cut out of the airfoil at the connection to the platform.

FIG. 5 is based on the FIG. 3. However, the second cooling passage 24 is connected to the first cooling structure without any interposed obstruction. Further the baffle structure 20 is not configured as an impingement plate but as a guiding plate for guiding cooling gas 33 leaving second cooling passage 24 along the fillet 16 for convective cooling of the fillet 16. In this arrangement the cooling gas first impingement cools the platform, then convectively cools the fillet 16 and is then fed into the impingement tube 22 to finally cool the airfoil 11.

Figure 6:
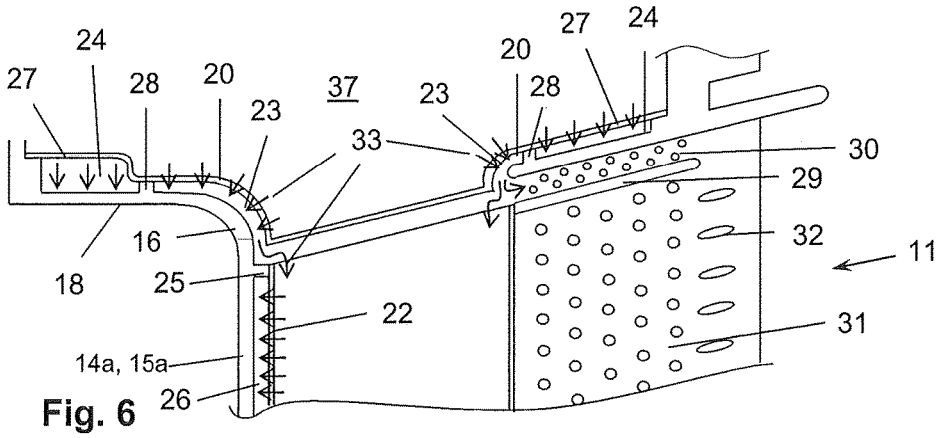
FIG. 6 shows another example the cross-section the platform and a cut out of the airfoil at the connection to the platform.

FIG. 6 is also based on the FIG. 3. The cooling design of the platform 18 is modified over the design of the example of FIG. 3. In this example the height of the second cooling passage 24 is changed. It is higher than the first cooling passage 23. An increased cooling passage height can be advantageous to guide large volume flow of cooling gas 33 through the passage. This can be used for example to guide cooling gas 33 which was used to cool the platform 18 in the leading edge region around the second obstruction 28 to the pressure side 14, respectively suction side 15 of the vane where it can be used for convectively cooling the fillet 16:

In FIG. 6 also a modification of the second convective cooling section 31 is shown. In this example a row of ribs 32 arranged at the trailing edge of the airfoil 11. These ribs 32 can be used for further heat transfer enhancement.

Figure 7:
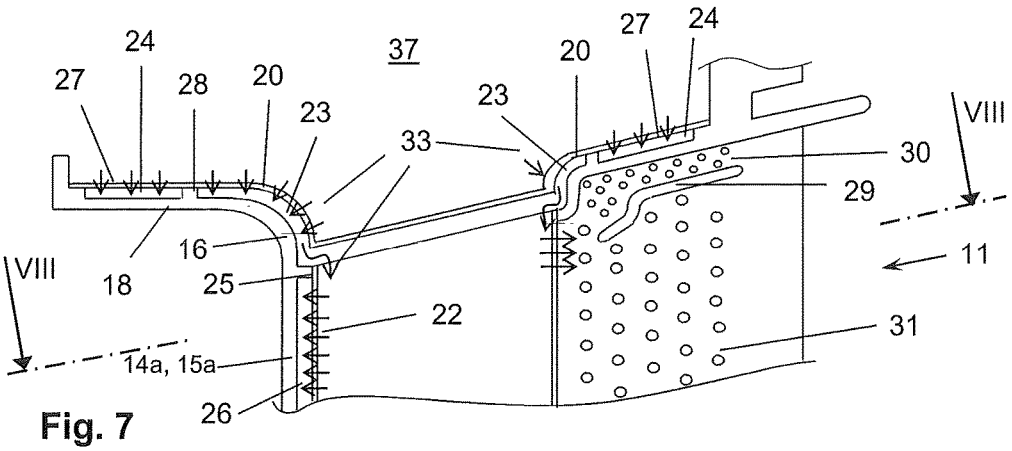
FIG. 7 shows another example the cross-section the platform and a cut out of the airfoil at the connection to the platform.

Another modification based on FIG. 3 is shown in FIG. 7. In this example the first and second convective cooling section 30, 31 are both supplied with cooling gas from the impingement tube 22 without a direct feed from the first cooling passage 23 into the first convective cooling section 30.

Figure 8:
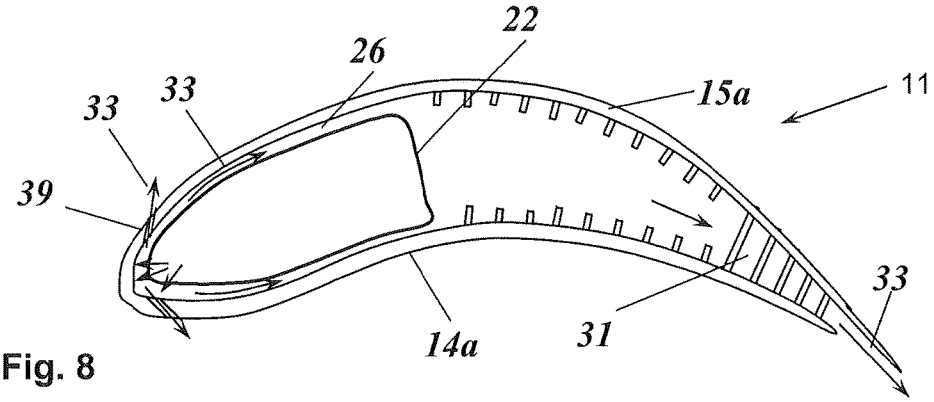
FIG. 8 shows exemplary cross-section of the airfoil.

FIG. 8 schematically shows the cross section VIII-VIII of FIG. 7 as a schematic example for cross section of an airfoil 11. The suction-side wall 15*a* and pressure-side wall 14*a* delimit a hollow cross section of airfoil 11. Towards the leading edge of the airfoil 11 an impingement tube 22 is arranged inside this hollow cross section. Cooling gas 33 is feed into the impingement tube and impinges on the inside of the suction-side wall 15*a* and pressure-side wall 14*a* for cooling. Subsequently, a part of the cooling gas 33 is used for film cooling and discharged via airfoil film cooling holes 39. Another part of the cooling gas 33 flows in the cooling channel 26 between the impingement tube 22 and the suction-side wall 15*a* respectively pressure-side wall 14*a* towards the second convective cooling section 31 and is discharge via the trailing edge of the airfoil 11.

The invention claimed is:

1. A vane comprising:

a platform; and an airfoil extending from said platform and connected to the platform by a fillet, wherein the airfoil which extends in longitudinal direction away from the platform has a pressure side and a suction side with a pressure side wall and a suction side wall, which join at a leading edge and at a trailing edge;

an impingement tube inserted into said airfoil delimiting a cooling channel between the impingement tube and the side walls;

a baffle structure positioned adjacent said fillet which follows an inside contour of the fillet and delimits a first cooling passage between the fillet and the baffle structure, a first obstruction arranged on an inside of the airfoil at the connection of the fillet to the side walls, the first obstruction separating the first cooling passage from the cooling channel;

a second impingement structure adjacent the platform delimits a second cooling passage between the platform and the second impingement structure; and a second obstruction arranged on an inside of the platform and separates the first cooling passage from the second cooling passage.

2. The vane according to claim 1, wherein the baffle structure comprises impingement holes for impingement cooling of the fillet.

3. The vane according to claim 1, wherein the second impingement structure follows a contour of the platform.

4. The vane according to claim 3, wherein the second obstruction is arranged on the inside of the platform at the connection between the second cooling passage and the first cooling passage for separating the first cooling passage.

5. The vane according to claim 4, wherein the second obstruction spans around a circumference of the fillet.

6. The vane according to claim 4, wherein the second obstruction extends around the leading edge and or the trailing edge for shielding the impingement cooling of the fillet from a cross flow of cooling gas coming from the second cooing passage towards the first cooing passage in a leading edge region and/or a trailing edge region of the fillet.

7. The vane according to claim 3, wherein the second cooling passage is connected to the first cooling passage such that cooling gas flows from the second cooling passage to first cooling passage for subsequent convective cooling of the fillet during operation.

8. The vane according to claim 1, wherein the first cooling passage has an opening to the impingement tube such that cooling gas flows from first cooling passage into the impingement tube for subsequent impingement cooling of the airfoil during operation.

9. The vane according to claim 1, wherein the fillet comprises a row of film cooling holes arranged in the fillet wall such that during operation cooling gas is used for film cooling of the fillet after impingement cooling and/or in that the platform comprises a convective cooling hole arranged in the platform such that during operation cooling gas is used for convective cooling of the platform after impingement cooling.

10. The vane according to claim 1, wherein the fillet has a curved shape with an outer surface facing hot gases during operation wherein a curvature of the fillet is tangential to an outer surface of the platform at the connection of the fillet to the platform and tangential to an outer surface of the airfoil at the connection of the fillet to the airfoil.

11. The vane according to claim 1, wherein a wall thickness of fillet is equal to a wall thickness of the platform at the connection to the platform and in that the wall thickness of the fillet is equal to a wall thickness of airfoil side walls at the connection to the airfoil side walls wherein the wall thickness of the fillet continuously decreases or continuously increases along an extension of the fillet from the platform to the airfoil side walls.

12. The vane according to claim 1, wherein the impingement tube is arranged in a leading edge section of the airfoil and a convective cooling section is arranged in a trailing edge section of the airfoil wherein the convective cooling section is divided into a first convective cooling section adjacent to the platform and into a second convective cooling section extending towards an opposite end of the airfoil by a wall.

13. The vane according to claim 12, wherein a cooling gas feed connects the first cooling passage to the first convective cooling section for directly feeding cooling gas from the first cooling passage to first convective cooling section.

14. A method for cooling a vane, wherein the vane includes a platform, an airfoil extending form said platform and connected to the platform by a fillet, wherein the airfoil which extends in longitudinal direction away from the platform has a pressure side and a suction side with a pressure side wall and a suction side wall, respectively, which join at a leading edge and at a trailing edge, and an impingement tube inserted into said airfoil delimiting a cooling channel between the impingement tube and the pressure and suction side walls; the method of cooling the vane comprising:

supplying cooling gas to a baffle structure positioned adjacent the fillet which follows an inside contour of the fillet;

delimiting a first cooling passage between the fillet and the baffle structure;

impinging the cooling gas onto the fillet for impingement cooling;

guiding the cooling gas via an obstruction arranged on an inside of the airfoil at the connection of the fillet to the pressure and suction side walls into the impingement tube; and impinging the cooling gas on the pressure and suction side walls.

* * * * *